US010183821B2

(12) United States Patent
Oshiro

(10) Patent No.: US 10,183,821 B2
(45) Date of Patent: Jan. 22, 2019

(54) PAPER FEED APPARATUS AND IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Toshiaki Oshiro, Izunokuni Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/426,122

(22) Filed: Feb. 7, 2017

(65) Prior Publication Data

US 2018/0222703 A1 Aug. 9, 2018

(51) Int. Cl.

| | |
|---|---|
| ***B65H 3/52*** | (2006.01) |
| ***B65H 3/06*** | (2006.01) |
| ***B65H 3/02*** | (2006.01) |
| ***G03G 15/00*** | (2006.01) |
| ***B65H 1/26*** | (2006.01) |
| ***B65H 5/06*** | (2006.01) |
| ***B65H 7/02*** | (2006.01) |
| ***B65H 3/56*** | (2006.01) |

(52) U.S. Cl.

CPC ..... *B65H 3/02* (2013.01); *B65H 1/266* (2013.01); *B65H 3/0684* (2013.01); *B65H 3/5223* (2013.01); *B65H 3/56* (2013.01); *B65H 5/062* (2013.01); *B65H 7/02* (2013.01); *G03G 15/6505* (2013.01); *G03G 15/6511* (2013.01); *B65H 2515/805* (2013.01); *B65H 2801/06* (2013.01)

(58) Field of Classification Search

CPC ..... B65H 3/56; B65H 3/565; B65H 3/5223; B65H 3/0684; B65H 2405/1136; B65H 2515/805

See application file for complete search history.

(56) References Cited

U.S. PATENT DOCUMENTS

| | | | | |
|---|---|---|---|---|
| 6,508,465 | B1 * | 1/2003 | Endo | B65H 3/06 271/265.01 |
| 7,331,575 | B2 * | 2/2008 | Kang | B65H 3/0669 271/121 |
| 7,588,246 | B2 * | 9/2009 | Kawamura | B65H 3/0684 271/124 |

(Continued)

*Primary Examiner* — Luis A Gonzalez

(74) *Attorney, Agent, or Firm* — Amin, Turocy & Watson LLP

(57) ABSTRACT

In accordance with an embodiment, a paper feed apparatus comprises a paper feed section, a separation section, an abutting section and a friction force variable section. The paper feed section feeds an image receiving medium. The separation section is arranged at the downstream side of the paper feed section in a conveyance direction of the image receiving medium. In a case in which a plurality of the image receiving media fed from the paper feed section is overlapped, the separation section separates the plurality of the image receiving media that is overlapped. The abutting section abuts against the image receiving medium fed from the paper feed section. The friction force variable section changes a friction force of the abutting section against the image receiving medium.

17 Claims, 10 Drawing Sheets

(56) References Cited

U.S. PATENT DOCUMENTS

| | | | | |
|---|---|---|---|---|
| 7,806,401 | B2 * | 10/2010 | Fukao | B65H 3/0661 271/10.03 |
| 8,733,755 | B2 | 5/2014 | Taniguchi | |
| 8,807,556 | B2 * | 8/2014 | Sugiyama | B65H 3/0684 271/124 |
| 8,910,932 | B2 * | 12/2014 | Rasmussen | B65H 3/565 271/121 |
| 9,272,859 | B2 * | 3/2016 | Sato | B65H 3/0669 |
| 2016/0257511 | A1 * | 9/2016 | Machida | B65H 1/04 |

* cited by examiner

PAPER FEED APPARATUS AND IMAGE FORMING APPARATUS

FIELD

Embodiments described herein relate generally to a paper feed apparatus, an image forming apparatus, and methods associated therewith.

BACKGROUND

Conventionally, there is a paper feed apparatus for sequentially feeding a plurality of laminated image receiving media towards a conveyance path. The paper feed apparatus is provided with a pickup roller, a pair of rollers, and a fixed friction section. The pickup roller sends out the plurality of the laminated image receiving media in order towards the conveyance path. The pair of rollers is arranged at the downstream side of the pickup roller in a conveyance direction of the image receiving medium. The pair of rollers is composed of a paper feed roller and a separation roller. An inclined section which is inclined in such a manner that a downstream side part thereof in the conveyance direction is positioned at an upper side is arranged between the pickup roller and the pair of rollers in the conveyance direction of the image receiving medium. The fixed friction section is fixed to a fixed position of the inclined section. The fixed friction section applies a friction force to the image receiving medium sent out from the pickup roller. However, there is a case in which the plurality of the image receiving media that is overlapped cannot be disposed/separated by the fixed friction section according to a coefficient of friction between the image receiving media and a surface state of the image receiving medium. In this case, if the plurality of the image receiving media that is overlapped is conveyed to the pair of rollers, there is a possibility that the plurality of the image receiving media cannot be separated by the separation roller and double feeding undesirably occurs.

DETAILED DESCRIPTION

Figure 1:
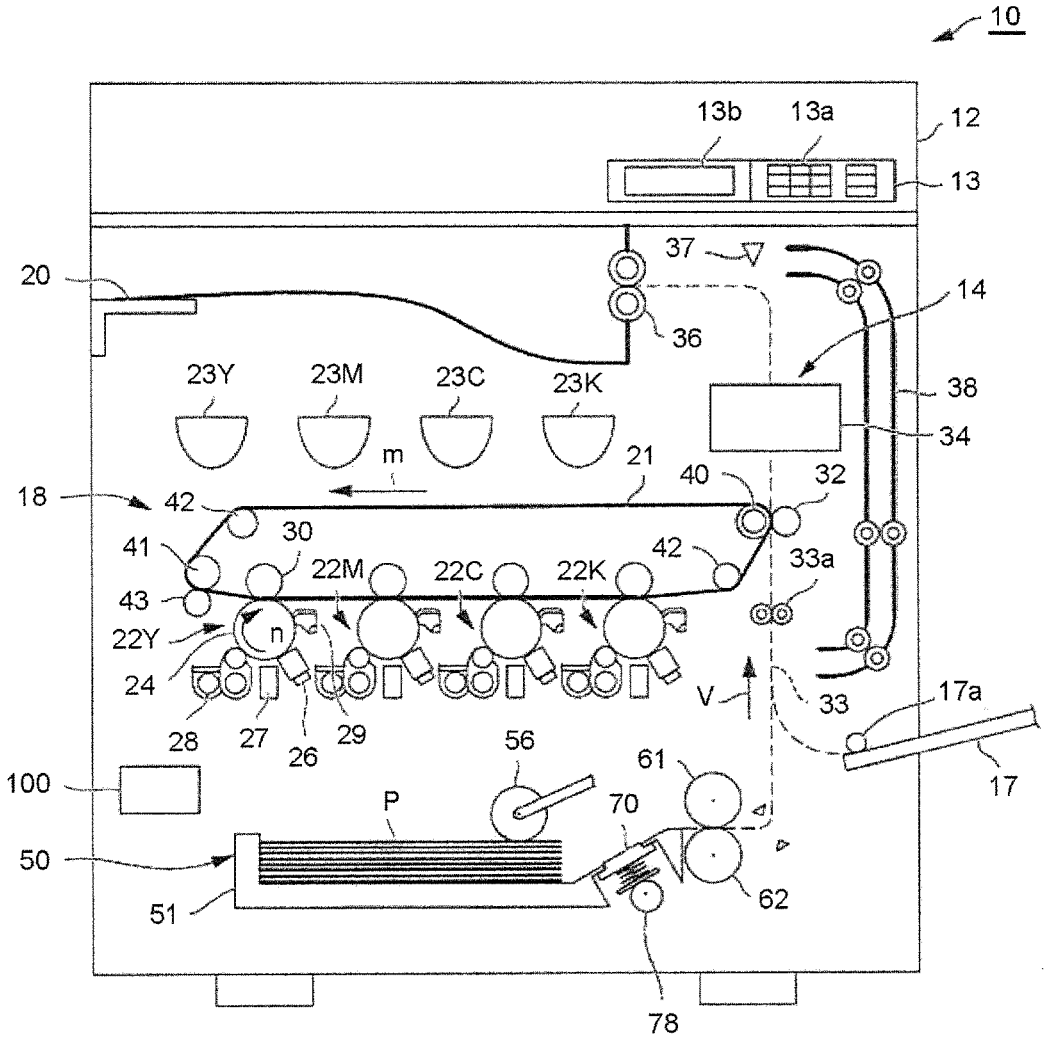
FIG. 1 is a side view illustrating an example of an image forming apparatus according to an embodiment.

In accordance with an embodiment, a paper feed apparatus comprises a paper feed section, a separation section, an abutting section and a friction force variable section. The paper feed section feeds an image receiving medium. The separation section is arranged at the downstream side of the paper feed section in a conveyance direction of the image receiving medium. In a case in which a plurality of the image receiving media fed from the paper feed section is overlapped, the separation section separates the plurality of the image receiving media that is overlapped. The abutting section abuts against the image receiving medium fed from the paper feed section. The friction force variable section changes a friction force of the abutting section against the image receiving medium.

Hereinafter, an image forming apparatus 10 of an embodiment is described with reference to the accompanying drawings. Furthermore, in each diagram, the same components are donated with the same reference numerals.

FIG. 1 is a side view illustrating an example of the image forming apparatus 10 according to the embodiment. Hereinafter, an MFP 10 is described as an example of the image forming apparatus 10.

The MFP 10 includes a scanner 12, a control panel 13 and a main body section 14. The scanner 12, the control panel 13 and the main body section 14 each are provided with a controller. The MFP 10 includes a system controller 100 for collectively controlling each controller. The main body section 14 is provided with a paper feed apparatus 50 and a printer section 18 (image forming section).

The scanner 12 reads a document image. The control panel 13 includes input keys 13*a* and a display section 13*b*. For example, the input keys 13*a* receive an input by a user. For example, the display section 13*b* is a touch panel type. The display section 13*b* receives an input by the user to display the input to the user.

The paper feed apparatus 50 includes a paper feed cassette 51 and a pickup roller 56. The paper feed cassette 51 houses a sheet-like image receiving medium (hereinafter, referred to as a "sheet") such as a paper. The pickup roller 56 takes out the sheet P from the paper feed cassette 51.

The paper feed cassette 51 feeds an unused sheet P. The sheet feed apparatus 50 supplies the sheet P towards the printer section 18. The paper feed tray 17 feeds the unused sheet P with a pickup roller 17*a*.

The printer section 18 forms an image. For example, the printer section 18 executes image formation of the document image read with the scanner 12. The printer section 18 is provided with an intermediate transfer belt 21. The printer section 18 supports the intermediate transfer belt 21 with a backup roller 40, a driven roller 41 and a tension roller 42. The backup roller 40 is provided with a drive section (not shown). The printer section 18 rotates the intermediate transfer belt 21 in an arrow m direction.

The printer section 18 includes 4 sets of image forming stations 22Y, 22M, 22C and 22K. The image forming stations 22Y, 22M, 22C and 22K are used to form Y (yellow), M (magenta), C (cyan) and K (black) images, respectively. The image forming stations 22Y, 22M, 22C and 22K are arranged in parallel below the intermediate transfer belt 21 along a rotation direction of the intermediate transfer belt 21.

The printer section 18 includes cartridges 23Y, 23M, 23C and 23K over the image forming stations 22Y, 22M, 22C and 22K. The cartridges 23Y, 23M, 23C and 23K store Y (yellow), M (magenta), C (cyan) and K (black) toner for replenishment, respectively.

Hereinafter, among the image forming stations 22Y, 22M, 22C and 22K, the image forming station 22Y of Y (yellow) is described as an example. Furthermore, as the image forming stations 22M, 22C and 22K have the same structure as the image forming station 22Y, the detailed description thereof is omitted.

The image forming station 22Y includes an electrostatic charger 26, an exposure scanning head 27, a developing device 28 and a photoconductor cleaner 29. The electrostatic charger 26, the exposure scanning head 27, the developing device 28 and the photoconductor cleaner 29 are arranged in the vicinity of the photoconductive drum 24 rotating in an arrow n direction.

The image forming station 22Y is provided with a primary transfer roller 30. The primary transfer roller 30 faces the photoconductive drum 24 across the intermediate transfer belt 21.

The image forming station 22Y exposes the photoconductive drum 24 with the exposure scanning head 27 after the photoconductive drum 24 is charged by the electrostatic charger 26. The image forming station 22Y forms an electrostatic latent image on the photoconductive drum 24. The developing device 28 uses a two-component developing agent composed of the toner and a carrier to develop the electrostatic latent image on the photoconductive drum 24.

The primary transfer roller 30 primarily transfers a toner image formed on the photoconductive drum 24 onto the intermediate transfer belt 21. The image forming stations 22Y, 22M, 22C and 22K form a color toner image on the intermediate transfer belt 21 with the primary transfer roller 30. The color toner image is formed by overlapping Y (yellow), M (magenta), C (cyan) and K (black) toner images in order. The photoconductor cleaner 29 removes the toner remaining on the photoconductive drum 24 after the primary transfer.

The printer section 18 is provided with a secondary transfer roller 32. The secondary transfer roller 32 faces the backup roller 40 across the intermediate transfer belt 21. The secondary transfer roller 32 secondarily transfers the color toner image on the intermediate transfer belt 21 onto the sheet P entirely. The sheet P is fed from the paper feed apparatus 50 or a manual feed tray 17 along a conveyance path 33.

The printer section 18 is provided with a belt cleaner facing the driven roller 41 across the intermediate transfer belt 21. The belt cleaner 43 removes the toner remaining on the intermediate transfer belt 21 after the secondary transfer.

The printer section 18 is provided with a register roller 33*a*, a fixing device 34 and a paper discharge roller 36 along the conveyance path 33. The printer section 18 is further provided with a bifurcation section 37 and a reverse conveyance section 38 at the downstream side of the fixing device 34. The bifurcation section 37 sends the sheet P after fixing to a sheet discharge section 20 or the reverse conveyance section 38. In the case of duplex printing, the reverse conveyance section 38 inverts the sheet P sent from the bifurcation section 37 to send it in the direction of the resist roller 33*a*. The MFP 10 forms a fixed toner image on the sheet P with the printer section 18 and then discharges it to the sheet discharge section 20.

Further, the MFP 10 is not limited to using a tandem developing system, and the number of the developing devices 28 therein is not limited. Alternatively, the MFP 10 may directly transfer the toner image from the photoconductive drum 24 onto the sheet P.

As stated above, the sheet P is conveyed from the paper feed apparatus 50 to the paper discharge section 20.

Hereinafter, in a conveyance direction V of the sheet P (hereinafter, referred to as a "sheet conveyance direction V"), the paper feed apparatus 50 side is set to an "upstream side". In the sheet conveyance direction V, the paper discharge section 20 side is set to a "downstream side".

Hereinafter, the paper feed apparatus 50 is described in detail.

Figure 2:
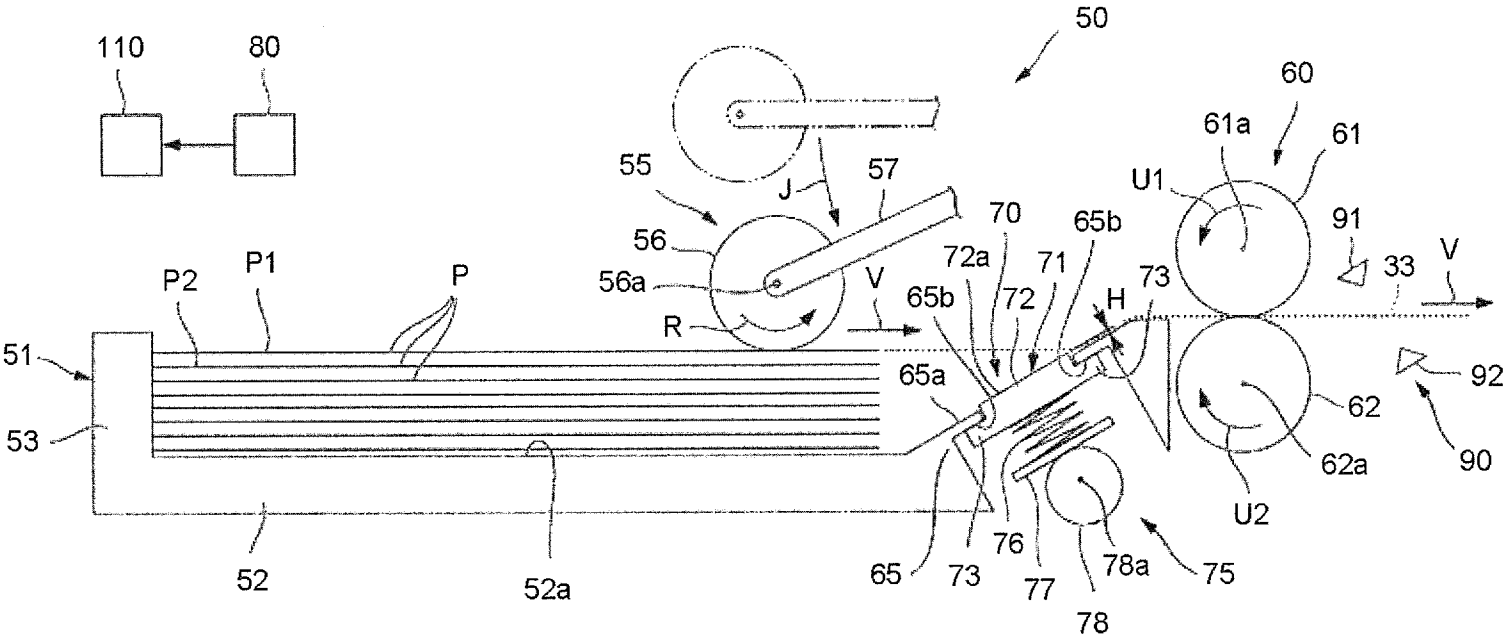
FIG. 2 is a side view illustrating an example of the schematic constitution of a paper feed apparatus according to the embodiment.

FIG. 2 is a side view illustrating an example of the schematic constitution of the paper feed apparatus 50 according to the embodiment.

As shown in FIG. 2, the paper feed apparatus 50 comprises a paper feed cassette 51, a delivery section 55, a separation section 60, an inclined section 65, an abutting section 71, a friction force variable section 70, a humidity sensor 80, a conveyance state detection sensor 90 and a control device 110.

First, the paper feed cassette 51 is described.

The paper feed cassette 51 houses a plurality of sheets P that is laminated (hereinafter, referred to as a "laminated sheet" in some cases). The paper feed cassette 51 is provided with a bottom wall 52 and a side wall 53.

The bottom wall 52 has a placing surface 52*a* on which the laminated sheet is placed. The placing surface 52*a* is flat substantially in parallel with a horizontal plane. An area of the placing surface 52*a* is larger than that of the sheet P.

The side wall 53 is arranged at a lateral side of the laminated sheet. In FIG. 2, the side wall 53 positioned at the upstream end of the bottom wall 52 is shown. The side wall 53 stands in a lamination direction of the laminated sheet. The height of the side wall 53 is higher than height of the laminated sheets. The side wall 53 is arranged at the lateral side of a sheet P that is initially sent out towards the conveyance path 33.

Next, the delivery section 55 is described.

The delivery section 55 is an example of a paper feed section for feeding the sheet P. The delivery section 55 sends out the plurality of the sheets P that is laminated in order towards the conveyance path 33. Specifically, the delivery section 55 sends out the plurality of the sheets P in order from a sheet P1 positioned at the uppermost side of the laminated sheet towards the conveying path 33. Hereinafter, the sheet P1 positioned at the uppermost side of the laminated sheet is referred to as a "first sheet P1" in some cases. The first sheet P1 is a sheet sent out towards the conveyance path 33 first. A sheet P2 that is sent out towards the conveyance path 33 next to the first sheet P1 is referred to as a "second sheet P2" in some cases.

The delivery section 55 is provided with the pickup roller 56 and a supporting member 57. The pickup roller 56 is formed into a cylindrical shape. For example, the pickup roller 56 is made of rubber. The pickup roller 56 is rotatable around a spindle 56*a*. The spindle 56*a* means a central axis (rotation axis) of the pickup roller 56. The spindle 56*a* has a length in a direction intersecting the sheet conveyance direction V. In the embodiment, the spindle 56*a* is substantially parallel to the horizontal direction and has a length in a direction substantially orthogonal to the sheet conveyance direction V.

The supporting member 57 rotatably supports the pickup roller 56. The pickup roller 56 is driven by a rotating body (not shown) such as a belt and the like to rotate in an arrow R direction. The supporting member 57 is energized towards an arrow J direction by an energizing member (not shown) such as a spring in such a manner that the pickup roller 56 is energized towards the upper surface of the laminated sheet.

For example, the supporting member 57 swings up and down in conjunction with accommodation of the laminated sheet in the paper feed cassette 51. Specifically, if the paper feed cassette 51 is empty, the supporting member 57 moves upward against an energizing force of the energizing member to float the pickup roller 56 in the air. In other words, if the laminated sheet is not housed in the paper feed cassette 51, the supporting member 57 stops at a position shown by a two-dot chain line in FIG. 2. On the other hand, if the laminated sheet is housed in the paper feed cassette 51, the supporting member 57 moves downward (in an arrow J direction) by the energizing member to enable the pickup roller 56 to abut against the upper surface of the laminated sheet.

The separation section 60 is described.

The separation section 60 is arranged at the downstream side of the delivery section 55 in the sheet conveyance direction V. The separation section 60 separates a plurality of the sheets P that is overlapped in a case in which the plurality of the sheets P sent out from the delivery section 55 is overlapped.

The separation section 60 includes a pair of rotating bodies 61 and 62 at least one of which is independently rotatable. The pair of the rotating bodies 61 and 62 respectively is rotatable around a plurality of rotating axes 61*a* and 62*a* substantially parallel to the spindle 56*a*. The pair of the rotating bodies 61 and 62 is arranged at positions that contribute to the formation of the conveyance path 33.

In the embodiment, the pair of the rotating bodies 61 and 62 is a paper feed roller 61 and a separation roller 62. The paper feed roller 61 and the separation roller 62 face each other across the conveyance path 33. The separation roller 62 is energized towards the paper feed roller 61 by an energizing member (not shown) such as a spring. The paper feed roller 61 and the separation roller 62 are respectively formed into a cylindrical shape. For example, the paper feed roller 61 and the separation roller 62 are rubber rollers. The outer shapes of the paper feed roller 61 and the separation roller 62 are substantially the same.

The paper feed roller 61 is arranged above the conveyance path 33. The paper feed roller 61 is rotatable around a first rotating axis 61*a* substantially parallel to the spindle 56*a*. The first rotating axis 61*a* means a central axis of the paper feed roller 61.

The separation roller 62 is arranged below the conveyance path 33. The separation roller 62 is rotatable around a second rotating axis 62*a* substantially parallel to the spindle 56*a*. The second rotating axis 62*a* means a central axis of the separation roller 62.

In the embodiment, the paper feed roller 61 is a drive roller connected to a drive section (not shown) such as a motor. The separation roller 62 contacts with the paper feed roller 61 to be driven by rotation of the paper feed roller 61.

Hereinafter, the rotation directions of the paper feed roller 61 and the separation roller 62 are described.

The paper feed roller 61 rotates in an arrow U1 direction by a drive section (not shown) such as a motor. In other words, the paper feed roller 61 rotates in the arrow U1 direction independently of the separation roller 62.

In a case in which the sheet P is not interposed between the paper feed roller 61 and the separation roller 62, the separation roller 62 is driven by the paper feed roller 61 to rotate in an arrow U2 direction. In other words, the separation roller 62 is driven to rotate by abutting against an outer peripheral surface of the paper feed roller 61 rotating in the arrow U1 direction.

For example, in a case in which one sheet P (i.e., the first sheet P1) is conveyed between the paper feed roller 61 and the separation roller 62, the first sheet P1 is conveyed towards the downstream side by the rotation of the paper feed roller 61. At this time, the separation roller 62 is driven to rotate by abutting against a lower surface of the first sheet P1 conveyed in the arrow V direction.

On the other hand, in a case in which two sheets P (i.e., the first sheet P1 and the second sheet P2) are conveyed between the paper feed roller 61 and the separation roller 62, only the first sheet P1 is conveyed towards the downstream side by the rotation of the paper feed roller 61. In a case in which two sheets P are inserted into a nip between the paper feed roller 61 and the separation roller 62, a driving force of the paper feed roller 61 does not reach the separation roller 62. If the driving force of the paper feed roller 61 does not reach the separation roller 62, the separation roller 62 stops rotating. If the separation roller 62 stops rotating, the first sheet 21 contacts with the paper feed roller 61. The first sheet P1 receives a force to be conveyed to the sheet conveyance direction V from the paper feed roller 61 by contacting with the paper feed roller 61. On the other hand, the separation roller 62 contacts with the second sheet P2 positioned below the first sheet P1. The separation roller 62 is formed by an elastic member with a friction force such as rubber. According to the above configuration, the separation roller 62 plays a role of a brake so that the second sheet P2 is not conveyed along with the first sheet P1. As the separation roller 62 plays the role of the brake, the two sheets P are separated and the first sheet P1 is first conveyed towards the downstream side.

The inclined section 65 is described.

The inclined section 65 is arranged between the delivery section 55 and the separation section 60 in the sheet conveyance direction V. Specifically, the inclined section 65 is located between the downstream end of the bottom wall 52 in the sheet conveyance direction V and the separation section 60. The inclined section 65 has an inclined surface 65*a* which is inclined in such a manner that a downstream side part thereof in the sheet conveyance direction V is positioned at an upper side (the separation section 60 side). For example, the inclined section 65 is made of resin such as plastic.

Next, the abutting section 71 is described.

The abutting section 71 is arranged at a vertically middle part of the inclined section 65. The abutting section 71 is arranged in the middle of the inclined section 65 in the sheet conveyance direction V. The abutting section 71 is capable of abutting against the sheet P sent out from the delivery section 55. The abutting section 71 is provided with an abutting section main body 72 and a flange section 73.

As mentioned above, the separation of the sheets P that are double fed is carried out by the paper feed roller 61 and the separation roller 62. However, it is desired that the plurality of the sheets P is not conveyed to the paper feed roller 61 and the separation roller 62. Therefore, at the time the sheet P is fed, the sheet P is struck against the abutting section 71 and double feeding is suppressed by the friction force of the abutting section 71 to the sheet P.

The abutting section main body 72 has a rectangular parallelepiped shape inclined in a direction along the inclined surface 65*a* of the inclined section 65. The abutting section main body 72 includes a projecting surface 72*a* inclined along the inclined surface 65*a* of the inclined section 65. The projecting surface 72*a* slightly projects over the inclined surface 65*a* of the inclined section 65. For example, a projecting height H of the protruding surface 72*a* is about 0.5 mm~1.0 mm.

The abutting section main body 72 applies the friction force to the sheet P sent out from the delivery section 55. For example, the abutting section main body 72 is an elastic member such as cork, rubber and the like. Hereinafter, a coefficient of friction of the projecting surface 72*a* in the abutting section main body 72 is referred to as a "projecting surface friction coefficient". A coefficient of friction of the inclined surface 65*a* in the inclined section 65 is referred to as an "inclined surface friction coefficient". The projecting surface friction coefficient is larger than the inclined surface friction coefficient.

The flange section 73 is arranged at a side opposite to the projecting surface 72*a* of the abutting section main body 72. The flange section 73 projects towards an external side of the abutting section main body 72 in the direction along the inclined surface 65*a* of the inclined section 65. The flange section 73 abuts against a surface 65*b* opposite to the inclined surface 65*a* of the inclined section 65.

The friction force variable section 70 is described.

The friction force variable section 70 is arranged between the delivery section 55 and the separation section 60 in the sheet conveyance direction V. The friction force variable section 70 changes the friction force (hereinafter, referred to as a "friction force against sheet") of the abutting section 71 against the sheet P. In other words, the friction force against sheet is the friction force to the sheet P sent out from the delivery section 55. The friction force variable section 70 is provided with an energizing force variable mechanism 75.

The energizing force variable mechanism 75 can increase or decrease the energizing force (hereinafter, referred to as an "energizing force against sheet") of the abutting section 71 against the sheet P sent out from the delivery section 55 between a first energizing force and a second energizing force. The second energizing force is larger than the first energizing force.

The energizing force variable mechanism 75 is provided with an energizing member 76, a supporting plate 77 and an energizing force adjusting cam 78.

The energizing member 76 is an elastic member that energizes the abutting section 71. For example, the energizing member 76 is a coil spring. One end of the energizing member 76 is mounted on a surface opposite to the projecting surface 72*a* of the abutting section main body 72. The other end of the energizing member 76 is mounted on one surface of the supporting plate 77. The supporting plate 77 is inclined along the inclined surface 65*a* of the inclined section 65. The energizing member 76 energizes the abutting section 71 in such a way as to set the energizing force against sheet to the first energizing force.

The energizing force adjusting cam 78 abuts against the other surface of the supporting plate 77. The energizing force adjusting cam 78 rotates around a fulcrum 78*a* by a drive section (not shown) such as a motor. The energizing force adjusting cam 78 can set the energizing force against sheet to the second energizing force by rotating against the energizing force of the energizing member 76.

Hereinafter, a distance between a point where the energizing force adjusting cam 78 contacts with the supporting plate 77 and the fulcrum is referred to as a "variable distance", and a distance between a surface opposite to the projecting surface 72*a* of the abutting section main body 72 and the one surface of the supporting plate 77 is referred to as a "separation distance".

In a case in which the variable distance is smaller than a predetermined distance, the separation distance becomes relatively large. In a case in which the separation distance is relatively large, the energizing force against sheet is relatively small.

On the other hand, in a case in which the variable distance is larger than the predetermined distance, the separation distance is relatively small. In a case in which the separation distance is relatively small, the energizing force against sheet is relatively large.

Therefore, according to the rotation of the energizing force adjusting cam 78 by motor driving, the magnitude of the energizing force against sheet can be adjusted.

In a state shown in FIG. 2, the variable distance is the minimum. In other words, in the state shown in FIG. 2, the separation distance is the maximum. Thus, the energizing force against sheet is the minimum. In the state shown in FIG. 2, the energizing force against sheet corresponds to the first energizing force.

Figure 3:
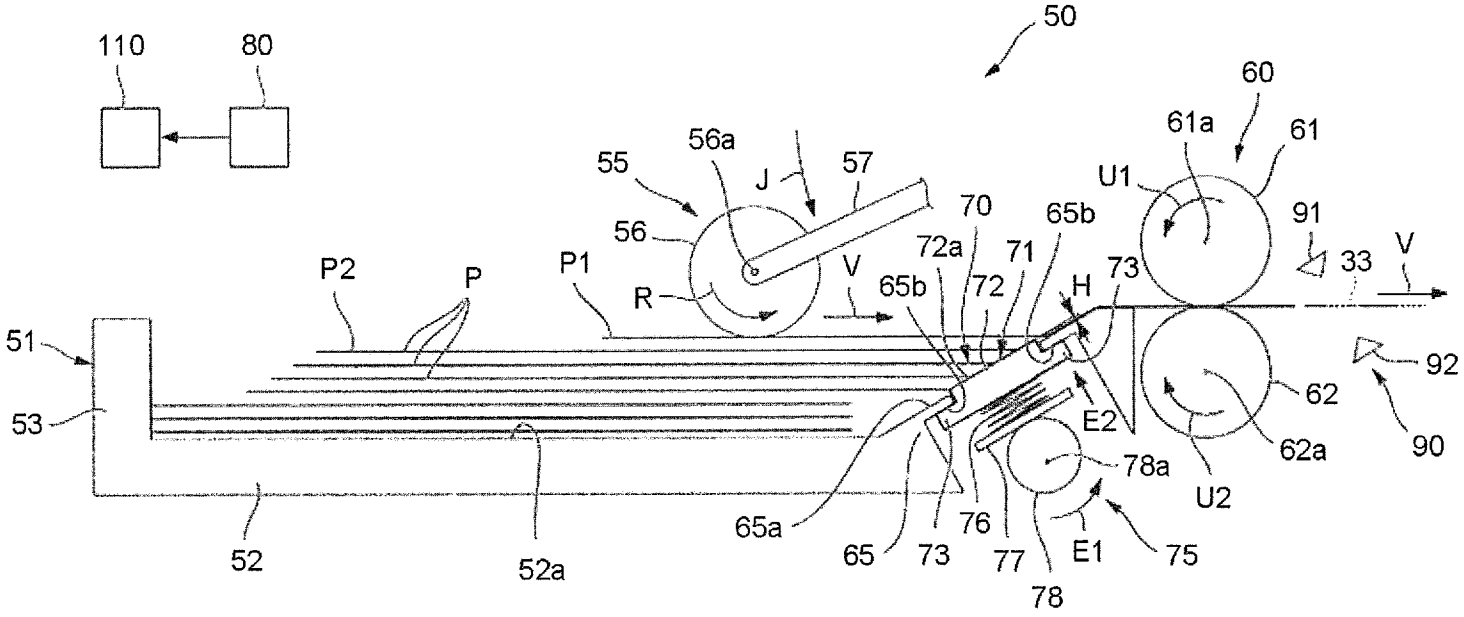
FIG. 3 is a view illustrating an example of the operation of a friction force variable section according to the embodiment.

FIG. 3 is a view illustrating an example of the operation of the friction force variable section 70 according to the embodiment. In a state shown in FIG. 3, through the rotating of the energizing force adjusting cam 78 in an arrow E1 direction, the variable distance is the maximum. In a state shown in FIG. 3, through the movement of the supporting plate 77 in an arrow E2 direction, the separation distance is the minimum. Thus, due to the compression of the energizing member 76, the energizing force against sheet is the maximum. In a state shown in FIG. 3, the energizing force against sheet corresponds to the second energizing force. Therefore, according to the rotation of the energizing force adjusting cam 78 by motor driving, the energizing force against sheet can be increased or decreased between the first energizing force and the second energizing force.

If the friction force against sheet is set to "F", the coefficient of friction of the abutting section 71 is set to "M" and the energizing force against sheet is set to "N", the following equation holds.

$$F=M*N$$

The coefficient of friction M is constant. The friction force against sheet F is directly proportional to the energizing force against sheet N. In other words, the friction force against sheet F is increased or decreased according to increase or decrease of the energizing force against sheet N.

The humidity sensor 80 is described.

For example, the humidity sensor 80 is mounted on a main body (housing) of the MFP 10 (refer to FIG. 1). The humidity sensor 80 detects humidity of outside air. For example, the humidity sensor 80 is a hygrometer for measuring the humidity of the outside air. A detection result of the humidity sensor 80 is output to the control device 110.

Based on the detection result of the humidity sensor 80, the control device 110 controls the friction force variable section 70 in such a way as to set the friction force against sheet to a reference friction force at the time the humidity of the outside air is lower than a humidity threshold value that is preset. The humidity threshold value is set to be equal to or smaller than humidity at which there is a possibility that the double feeding occurs. In the embodiment, the reference friction force is set to a friction force at the time of the first energizing force.

On the other hand, based on the detection result of the humidity sensor 80, the control device 110 controls the friction force variable section 70 in such a manner that the friction force against sheet is greater than the reference friction force at the time the humidity of the outside air is greater than the humidity threshold value.

The control device 110 controls the rotation of the energizing force adjusting cam 78 based on the detection result of the humidity sensor 80.

The energizing force adjusting cam 78 maintains the energizing force against sheet at the first energizing force without rotating against the energizing force of the energizing member 76 at the time the humidity of the outside air is lower than the humidity threshold value.

On the other hand, at the time the humidity of the outside air is greater than the humidity threshold value, the energizing force adjusting cam 78 rotates against the energizing force of the energizing member 76 via the supporting plate 77 in such a manner that the energizing force against sheet is greater than the first energizing force.

The conveyance state detection sensor 90 is described.

The conveyance state detection sensor 90 is arranged at the downstream side of the separation section 60 in the sheet conveyance direction V. The conveyance state detection sensor 90 detects a conveyance state of the sheet P passing through the separation section 60. For example, the detection result is an ultrasonic sensor. A detection result of the conveyance state detection sensor 90 is output to the control device 110.

The conveyance state detection sensor 90 includes a transmitter 91 and a receiver 92. The transmitter 91 and the receiver 92 face each other across the conveyance path 33. The transmitter 91 and the receiver 92 are arranged at positions that are mutually separated. An arrangement direction of the transmitter 91 and the receiver 92 is inclined with respect to the conveyance path 33.

The transmitter 91 is arranged above the conveyance path 33. The transmitter 91 emits ultrasonic wave towards the sheet P passing through the separation section 60. The ultrasonic wave emitted to the sheet P passing through the separation section 60 is reflected by the sheet P.

The receiver 92 is arranged below the conveyance path 33. The receiver 92 receives reflected wave reflected by the sheet P passing through the separation section 60. The conveyance state detection sensor 90 detects the conveyance state of the sheet P passing through the separation section 60 based on waveform of the reflected wave received by the receiver 92 and time required from emission of the ultrasonic wave to reception of the ultrasonic wave.

Based on the detection result of the conveyance state detection sensor 90, in a case in which the number of the sheets P passing through the separation section 60 is one, the control device 110 controls the friction force variable section 70 in such a way as to set the friction force against sheet to the reference friction force.

On the other hand, based on the detection result of the conveyance state detection sensor 90, in a case in which the plurality of the sheets P passing through the separation section 60 is overlapped, the control device 110 controls the friction force variable section 70 in such a manner that the friction force against sheet is greater than the reference friction force.

The control device 110 controls the rotation of the energizing force adjusting cam 78 based on the detection result of the conveyance state detection sensor 90.

In a case in which the number of the sheets P passing through the separation section 60 is one, the energizing force adjusting cam 78 maintains the energizing force against sheet at the first energizing force without rotating against of the energizing force of the energizing member 76.

On the other hand, in a case in which the plurality of the sheets P passing through the separation section 60 is overlapped, the energizing force adjusting cam 78 rotates against the energizing force of the energizing member 76 via the supporting plate 77 in such a manner that the energizing force against sheet is greater than the first energizing force.

An example of the control by the control device 110 is described.

Figure 4:
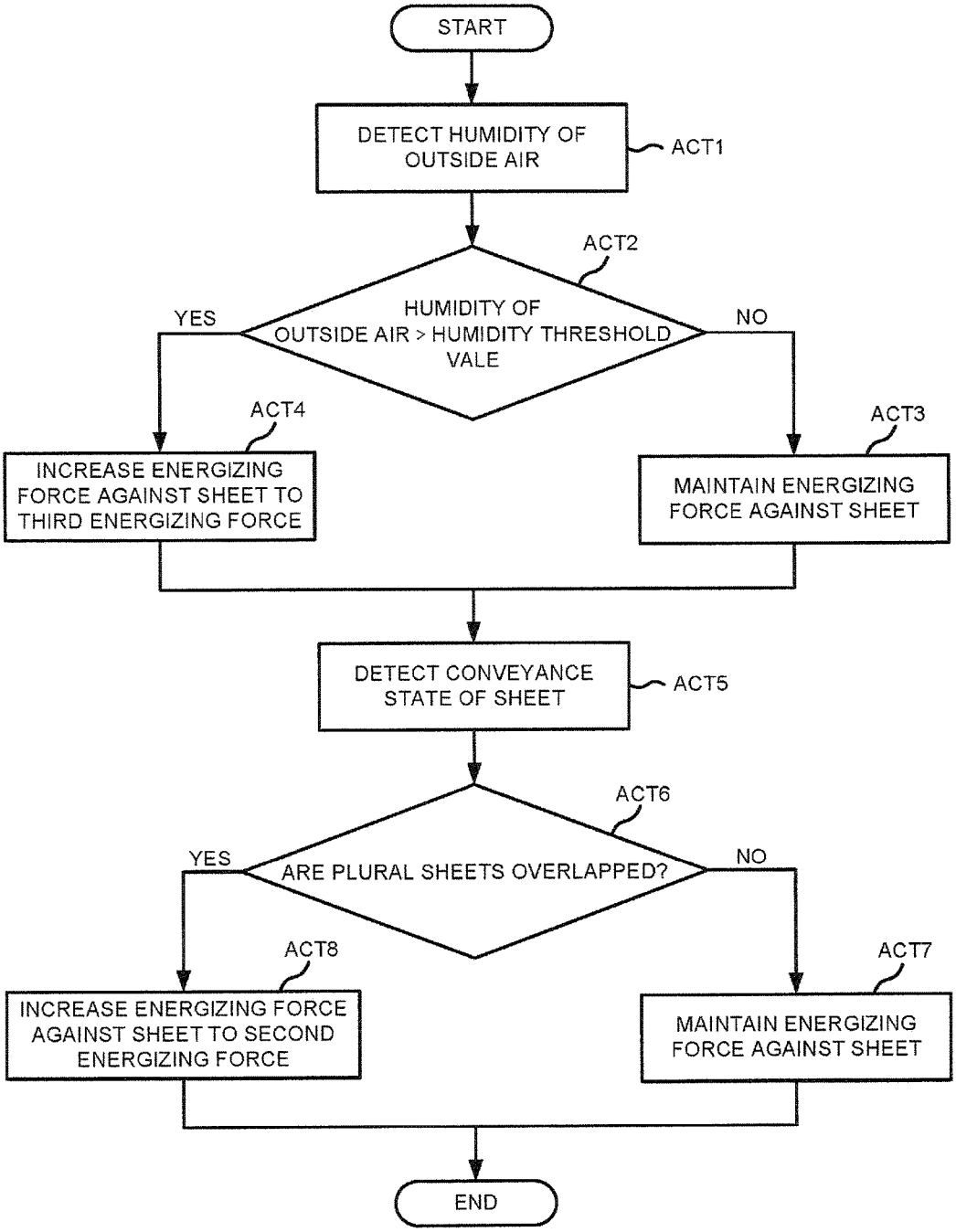
FIG. 4 is a flowchart illustrating an example of the control by a control device according to the embodiment.

FIG. 4 is a flowchart illustrating an example of the control by the control device 110 according to the embodiment.

As shown in FIG. 4, first, the control device 110 detects the humidity of the outside air from the detection result of the humidity sensor 80 (ACT 1).

The control device 110 determines whether or not the humidity of the outside air is greater than the preset humidity threshold value based on the detection result of the humidity sensor 80 (ACT 2).

If the humidity of the outside air is lower than the humidity threshold value (No in ACT 2), the control device 110 controls the friction force variable section 70 in such a way as to set the friction force against sheet to the reference friction force (ACT 3). In ACT 3, the energizing force adjusting cam 78 maintains the energizing force against sheet at the first energizing force without rotating against the energizing force of the energizing member 76 at the time the humidity of the outside air is lower than the humidity threshold value.

On the other hand, if the humidity of the outside air is greater than the humidity threshold value (Yes in ACT 2), the control device 110 controls the friction force variable section 70 in such a manner that the friction force against sheet is greater than the reference friction force (ACT 4). In ACT 4, the energizing force adjusting cam 78 rotates against the energizing force of the energizing member 76 via the supporting plate 77 in such a manner that the energizing force against sheet is greater than the first energizing force at the time the humidity of the outside air is greater than the humidity threshold value. For example, the energizing force adjusting cam 78 sets the energizing force against sheet to a third energizing force at the time the humidity of the outside air is greater than the humidity threshold value. The magnitude of the third energizing force is larger than the first energizing force and smaller than the second energizing force.

The control device 110 detects the conveyance state of the sheet P from the detection result of the conveyance state detection sensor 90 (ACT 5).

The control device 110 determines whether or not the plurality of the sheets P passing through the separation section 60 is overlapped based on the detection result of the conveyance state detection sensor 90 (ACT 6).

If the plurality of the sheets P passing through the separation section 60 is not overlapped (No in ACT 6), the control device 110 controls the friction force variable section 70 in such a way as to maintain the friction force against sheet (ACT 7). In ACT 7, the energizing force adjusting cam 78 maintains the energizing force against sheet at the first energizing force without rotating against the energizing force of the energizing member 76 if the number of the sheets P passing through the separation section 60 is one. Alternatively, if the energizing force against sheet is set to the third energizing force in ACT 4, in ACT 7, the energizing force adjusting cam 78 maintains the energizing force against sheet at the third energizing force without rotating against the energizing force of the energizing member 76.

On the other hand, if the plurality of the sheets P passing through the separation section 60 is overlapped (Yes in ACT 6), the control device 110 controls the friction force variable section 70 in such a manner that the friction force against sheet is greater than the reference friction force (ACT 8). In ACT 8, the energizing force adjusting cam 78 rotates against the energizing force of the energizing member 76 via the supporting plate 77 in such a manner that the energizing force against sheet is greater than the first energizing force if the plurality of the sheets P passing through the separation section 60 is overlapped. For example, the energizing force adjusting cam 78 sets the energizing force against sheet to the second energizing force if the plurality of the sheets P passing through the separation section 60 is overlapped.

The functional components of the image forming apparatus 10 are described.

Figure 5:
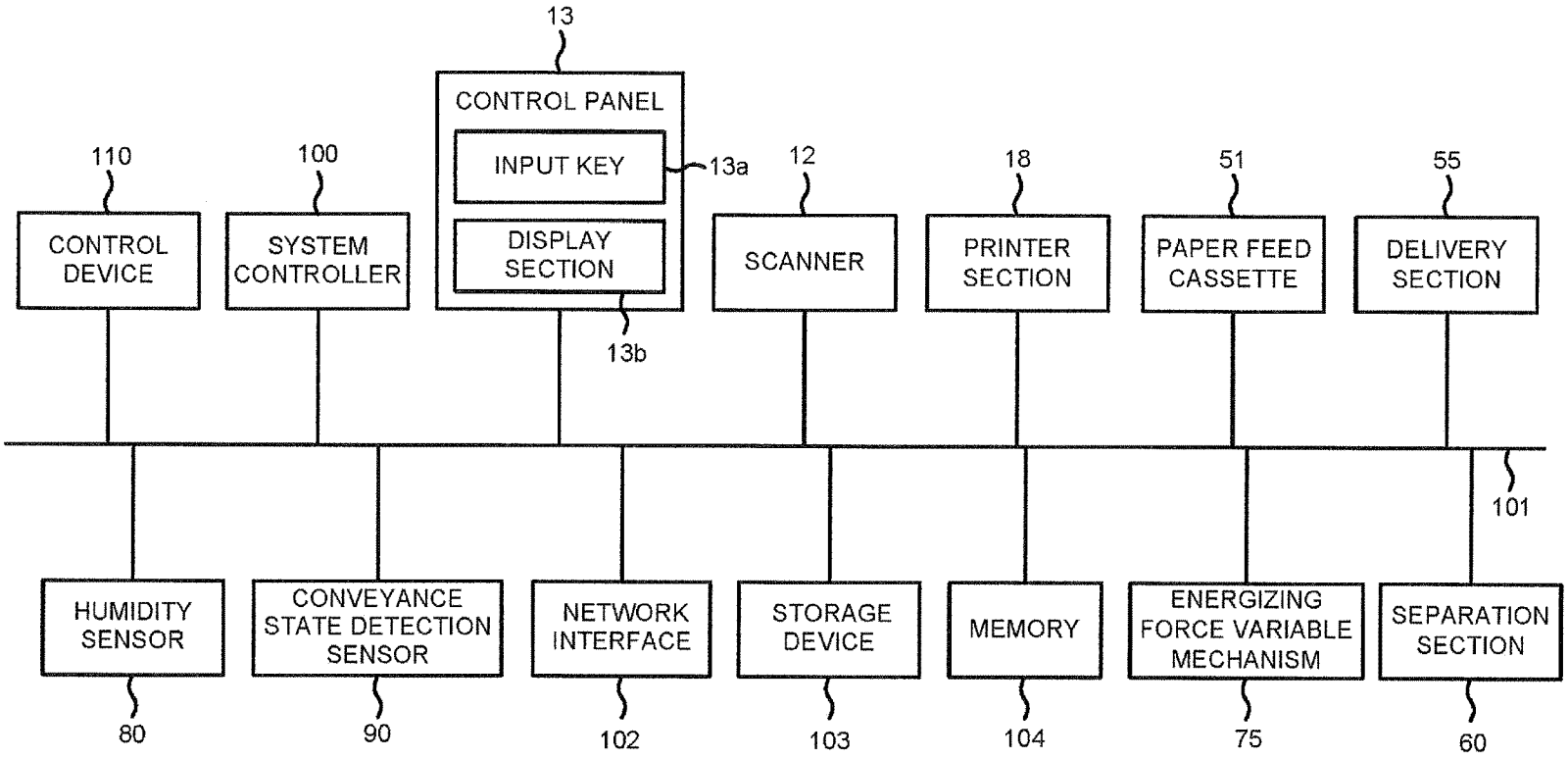
FIG. 5 is a block diagram illustrating an example of the functional components of the image forming apparatus according to the embodiment.

FIG. 5 is a block diagram illustrating an example of the functional components of the image forming apparatus 10 according to the embodiment.

As shown in FIG. 5, the functional sections of the image forming apparatus 10 are connected to be capable of carrying out data communication via a system bus 101.

The system controller 100 controls the operation of each functional section of the image forming apparatus 10. The system controller 100 executes various processing by executing programs. The system controller 100 acquires an instruction input by a user from the control panel 13. The system controller 100 executes a control processing based on the acquired instruction.

A network interface 102 transmits and receives data to and from other devices. The network interface 102 operates as an input interface to receive data transmitted from other devices. The network interface 102 also operates as an output interface to transmit data to other devices.

A storage device 103 stores various data. For example, the storage device 103 is a hard disk or an SSD (Solid State Drive). For example, various data includes digital data, screen data of a setting screen, setting information, job and a job log. The digital data is generated by the scanner 12 as an image reading section. The setting screen is used to carry out operation setting of the energizing force variable mechanism 75. The setting information relates to the operation setting of the energizing force variable mechanism 75.

A memory 104 temporarily stores data used by each functional section. For example, the memory 104 is a RAM (Random Access Memory). For example, the memory 104 temporarily stores digital data, a job and a job log.

The operation of the energizing force variable mechanism 75 in response to the type of the sheet P is described.

The system controller 100 controls the operation of the energizing force variable mechanism 75 according to the type of the sheet P. In a case in which the sheet is a sheet (hereinafter, referred to as a "sheet with low adhesion") that is difficult to adhere at the time the sheets P are laminated, the energizing force against sheet is maintained (refer to FIG. 2) without operating the energizing force variable mechanism 75. In other words, in a case in which the sheet P is the sheet with low adhesion, the energizing force against sheet is maintained at the first energizing force.

On the other hand, in a case in which the sheet is a sheet (hereinafter, referred to as "sheet with high adhesion") that is easy to adhere at the time the sheets P are laminated, the energizing force against sheet is increased (refer to FIG. 3) by operating the energizing force variable mechanism 75 with input keys 13*a* such as buttons or the like. For example, in a case in which the sheet P is the sheet with high adhesion, by pressing the button by the user, the energizing force adjusting cam 78 may be rotated to switch to the state shown in FIG. 3.

If the fixed friction section is fixed to a fixed position of the inclined section, due to the coefficient of friction between the sheets P and the surface state of the sheet P, there is a case in which the plurality of the sheets P that is overlapped cannot be disposed by the fixed friction section.

The surface state of the sheet P contains roughness of the surface of the sheet P. As other factors why the plurality of the sheets P that is overlapped cannot be disposed by the fixed friction section, external factors such as humidity and temperature, static electricity between the sheets P, and the storage time of the laminated sheet are exemplified.

If the plurality of the sheets P that is overlapped is conveyed to a pair of rollers, there is a possibility that the plurality of the sheets P cannot be separated by the separation roller 62 and the double feeding occurs. Hereinafter, the constitution in which the fixed friction section 70X is fixed at a fixed position of the inclined section 65X is set as a "comparative embodiment".

Figure 6:
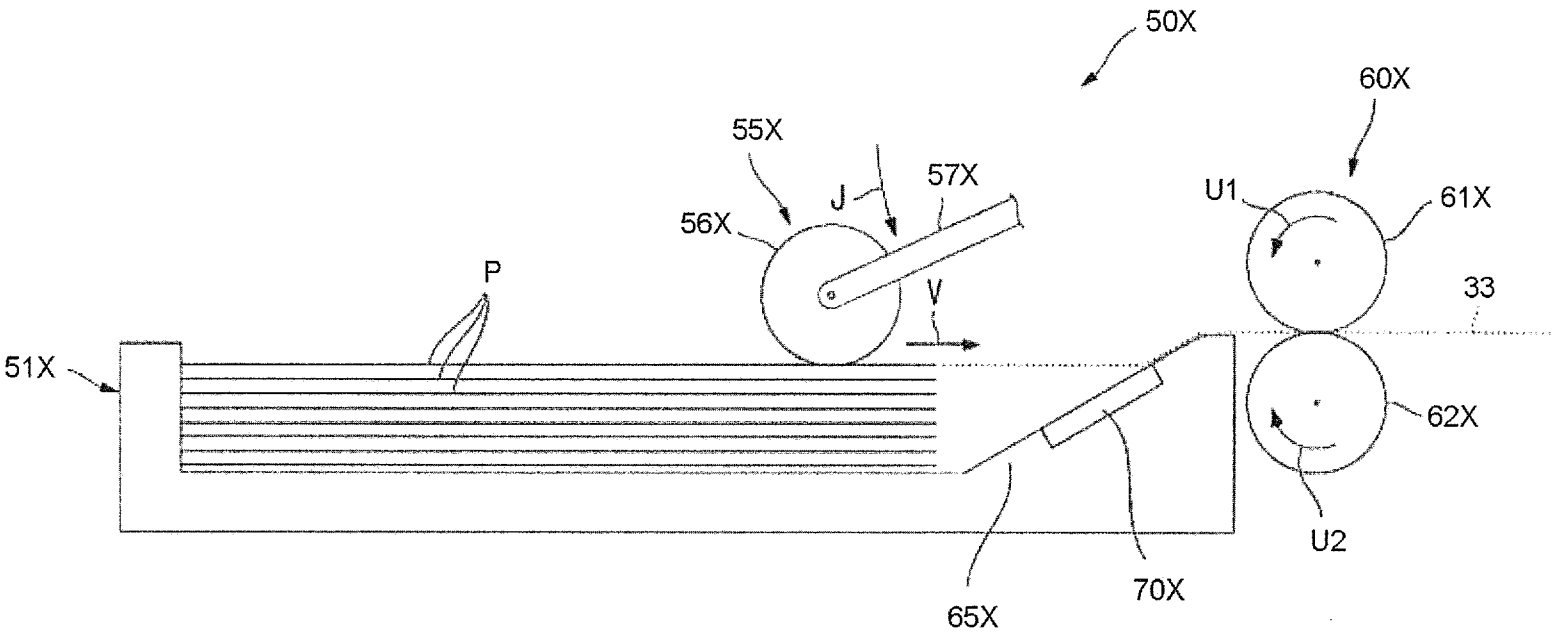
FIG. 6 is a side view illustrating an example of the schematic constitution of a paper feed apparatus according to a comparative embodiment.

FIG. 6 is a side view illustrating an example of the schematic constitution of a paper feed apparatus 50X according to the comparative embodiment.

As shown in FIG. 6, the paper feed apparatus 50X according to the comparative embodiment includes a paper feed cassette 51X, a delivery section 55X, a separation section 60X, an inclined section 65X and a fixed friction section 70X. The paper feed apparatus 50X according to the comparative embodiment does not include the friction force variable section 70 (refer to FIG. 2) of the embodiment. In FIG. 6, a pickup roller 56X is energized in an arrow J direction towards the upper surface of the laminated sheet and stops.

Figure 7:
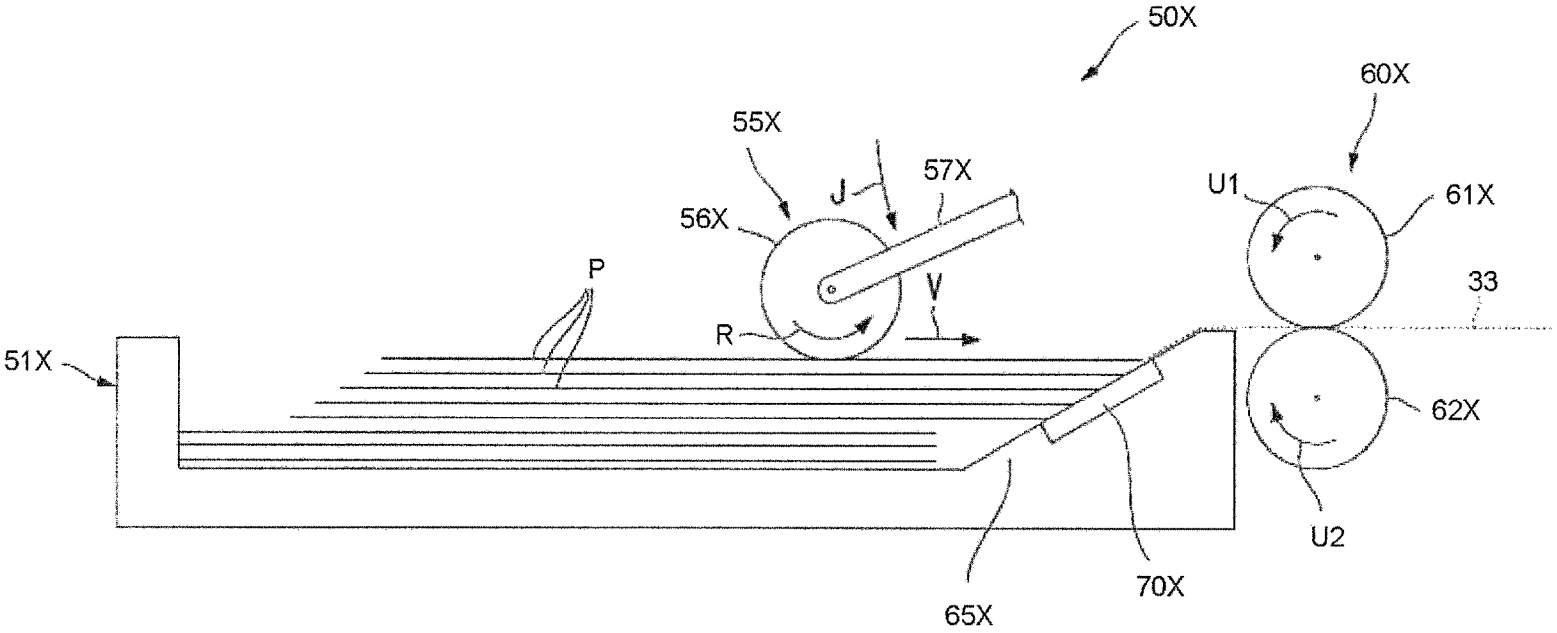
FIG. 7 is a view illustrating a principle of occurrence of a double feeding.

FIG. 7 is a view illustrating a principle of occurrence of a double feeding.

As shown in FIG. 7, the pickup roller 56X rotates in an arrow R direction by being energized in the arrow J direction towards the upper surface of the laminated sheet. The pickup roller 56X feeds the plurality of the sheets P that is overlapped in order towards the conveyance path 33. Due to the coefficient of friction between the sheets P and the surface state of the sheet P, the plurality of the sheets P that is overlapped is inclined in such a manner that the upper side thereof is positioned at the downstream side in the sheet conveyance direction V.

Figure 8:
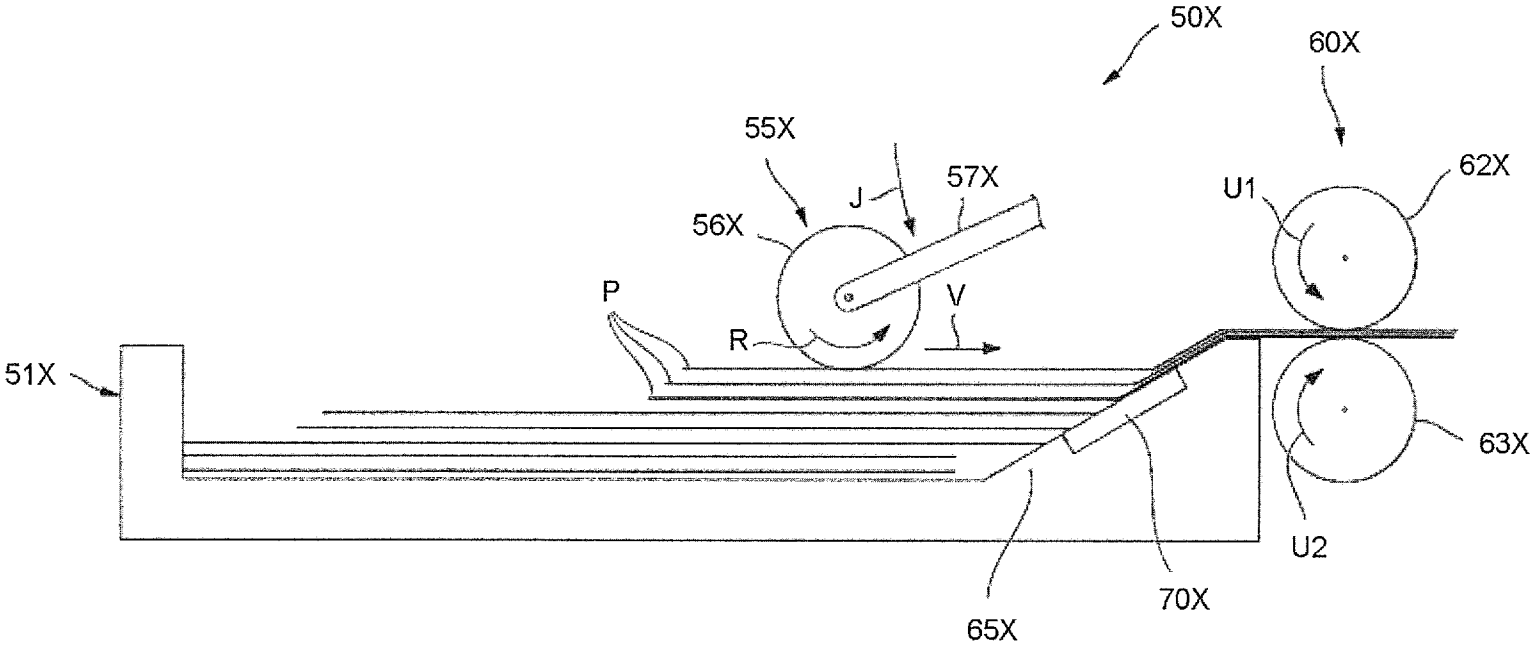
FIG. 8 is a view illustrating the principle of occurrence of a double feeding following FIG. 7.

FIG. 8 is a view illustrating the principle of occurrence of the double feeding following FIG. 7.

As shown in FIG. 8, due to the coefficient of friction between the sheets P and the surface state of the sheet P, there is a case in which the plurality of the sheets P that is overlapped cannot be disposed by the fixed friction section 70X. For example, in a case in which an adhesion force of the plurality of the sheets P is greater than the friction force applied to the sheet P by the fixed friction section 70X, the plurality of the sheets P that is overlapped cannot be disposed by the fixed friction section 70X.

As stated above, if the plurality of the sheets P that is overlapped cannot be disposed by the fixed friction section 70X, the plurality of the sheets P that is overlapped is conveyed to a pair of rollers 61X and 62X. In this way, there is a possibility that the plurality of the sheets P cannot be separated by the separation roller 62X and the double feeding occurs.

According to the embodiment, the paper feed apparatus 50 includes the delivery section 55, the separation section 60, the abutting section 71 and the friction force variable section 70. The delivery section 55 sends out the plurality of the sheets P that is overlapped in order towards the conveyance path 33. The separation section 60 is arranged at the downstream side of the delivery section 55 in the sheet conveyance direction V. The separation section 60 separates the plurality of the sheets P that is overlapped in a case in which the plurality of the sheets P sent out from the delivery section 55 is overlapped. The abutting section 71 is arranged between the delivery section 55 and the separation section 60 in the sheet conveyance direction V. The abutting section 71 abuts against the sheet P sent out from the delivery section 55. The friction force variable section 70 changes the friction force against sheet. With the above constitution, the following effect is achieved. The friction force variable section 70 changes the friction force against sheet, and in this way, in a case in which the plurality of the sheets P sent out from the delivery section 55 is overlapped, the plurality of the sheets P that is overlapped can be easily separated. Thus, it is possible to suppress the occurrence of the double feeding.

From the viewpoint of reducing the cost of the sheet P, a recycled paper may be used as the sheet P instead of a plain paper. However, in a case of using the recycled paper as the sheet P, since fibers of the recycled paper are shorter than the plain paper and easy to untwist at the edge of the sheet, the possibility increases that the untwisted fibers are tangled with each other and are double fed. According to the embodiment, even if the recycled paper is used as the sheet P, since the plurality of the sheets P that is overlapped is easy to separate by the friction force variable section 70, the double feeding can be further suppressed.

From the viewpoint of suppressing the occurrence of the double feeding, it is conceivable to maintain the friction force against sheet at a high level at which the double feeding does not occur. However, in a case in which the friction force against sheet is maintained at a high level, there is a possibility that the sheet P is damaged depending on the type of the sheet P. For example, depending on the type of the sheet P, there is a possibility that the friction force against sheet is too high to bend or break the downstream end of the sheet P. According to the embodiment, since the friction force against sheet can be reduced according to the type of the sheet P, the damage to the sheet P can be avoided.

The friction force variable section 70 includes the energizing member 76 which energizes the abutting section 71. With the above constitution, the following effect is achieved. The energizing force can be applied to the sheet P that abuts against the abutting section 71 by the energizing member 76. Therefore, it is possible to further suppress the occurrence of the double feeding as compared with the constitution in which the friction force variable section 70 is only provided with the abutting section 71 (i.e., without the energizing member 76). For example, in a case in which the energizing member 76 is a coil spring, the following effect is achieved. The sheet P sent out from the delivery section 55 abuts (collides) against the abutting section 71. The coil spring is temporarily compressed by abutment of the sheet P against the abutting section 71. The coil spring is stretched to return to an original state after being compressed. Thus, it is possible to apply a reaction force of the coil spring to the sheet P abutting against the abutting section 71. In addition, as the number of sheets P abutting against the abutting section 71 is increased, the coil spring is greatly compressed. The reaction force of the coil spring can be increased as the number of the sheets P abutting the abutting section 71 is increased. Thus, the energizing force can be applied in response to the number of sheets P sent out from the delivery section 55.

The friction force variable section 70 includes the energizing force variable mechanism 75 that can increase or decrease the energizing force against sheet between the first energizing force and the second energizing force. With the above constitution, the following effect is achieved. A large setting range of the energizing force against the sheet P abutting the abutting section 71 can be ensured as compared with the case in which the energizing force against sheet is kept constant. The energizing force against sheet becomes easy to set according to the type of the sheet P, and thus, the occurrence of the double feeding can be further suppressed.

The energizing force variable mechanism 75 includes the energizing member 76 and the energizing force adjusting cam 78. The energizing member 76 energizes the abutting section 71 in such a way as to set the energizing force against sheet to the first energizing force. The energizing force adjusting cam 78 can set the energizing force against sheet to the second energizing force by rotating against the energizing force of the energizing member 76. With the above constitution, the following effect is achieved. With the simple structure using the cam mechanism, the occurrence of the double feeding can be further suppressed.

The inclined section 65 is arranged between the delivery section 55 and the separation section 60 in the sheet conveyance direction V. The inclined section 65 has the inclined surface 65*a* which is inclined in such a manner that a downstream side part thereof in the sheet conveyance direction V is located at the upper side. The abutting section 71 has the projecting surface 72*a* which is inclined along the inclined surface 65*a* and protrudes over the inclined surface 65*a*. With the above constitution, the following effect is achieved. The abutting section 71 is easy to abut against the sheet P sent out from the delivery section 55 as compared with the case in which the abutting section 71 is connected to the same surface as the inclined surface 65*a* or recessed with respect to the inclined surface 65*a*. Thus, the occurrence of the double feeding can be further suppressed.

The humidity sensor 80 detects the humidity of the outside air. At the time the humidity of the outside air is lower than the preset humidity threshold value, the control device 110 controls the friction force variable section 70 in such a way as to set the friction force against sheet to the reference friction force based on the detection result of the humidity sensor 80. Based on the detection result of the humidity sensor 80, the control device 110 controls the friction force variable section 70 in such a manner that the friction force against sheet is greater than the reference friction force at the time the humidity of the outside air is greater than the humidity threshold value. With the above constitution, the following effect is achieved. In a situation where the double feeding may occur due to high humidity of the outside air, the friction force variable section 70 is automatically operated at a proper timing, and the friction force against sheet can be automatically increased. Therefore, even in the situation where the double feeding may occur due to the high humidity of the outside air, the occurrence of the double feeding can be further suppressed.

The conveyance state detection sensor 90 detects the conveyance state of the sheet P passing through the separation section 60. Based on the detection result of the conveyance state detection sensor 90, the control device 110 controls the friction force variable section 70 in such a way as to set the friction force against sheet to the reference friction force in a case in which the number of the sheets P passing through the separation section 60 is one. Based on the detection result of the conveyance state detection sensor 90, the control device 110 controls the friction force variable section 70 in such a manner that the friction force against sheet is greater than the reference friction force if the plurality of the sheets P passing through the separation section 60 is overlapped. With the above constitution, the following effect is achieved. Even if the friction force variable section 70 tries to separate the plurality of overlapping sheets P, in a case in which a plurality of sheets P is overlapped, the friction force variable section 70 is automatically operated, and the friction force against sheet can be automatically increased. Thus, the occurrence of the double feeding can be suppressed afterwards.

The separation section 60 is provided with the pair of the rotating bodies 61 and 62 at least one of which is independently rotatable, and in this way, the following effect is achieved. In a case in which a plurality of the sheets P sent from the friction force variable section 70 is overlapped, the plurality of the sheets P that is overlapped can be separated by the pair of the rotating bodies 61 and 62. If only two sheets P are overlapped, it is possible to reliably separate the two sheets P overlapped with the pair of the rotating bodies 61 and 62. For example, in a case in which two sheets P (i.e., the first sheet P1 and the second sheet P2) are conveyed between the paper feed roller 61 and the separation roller 62, through the rotation of the paper feed roller 61, only the first sheet P1 can be conveyed towards the downstream side. At this time, the separation roller 62 abuts against the lower surface of the second sheet P2 to separate the second sheet P2 from the first sheet P1.

Hereinafter, modifications are described.

First, a first modification of the embodiment is described.

Figure 9:
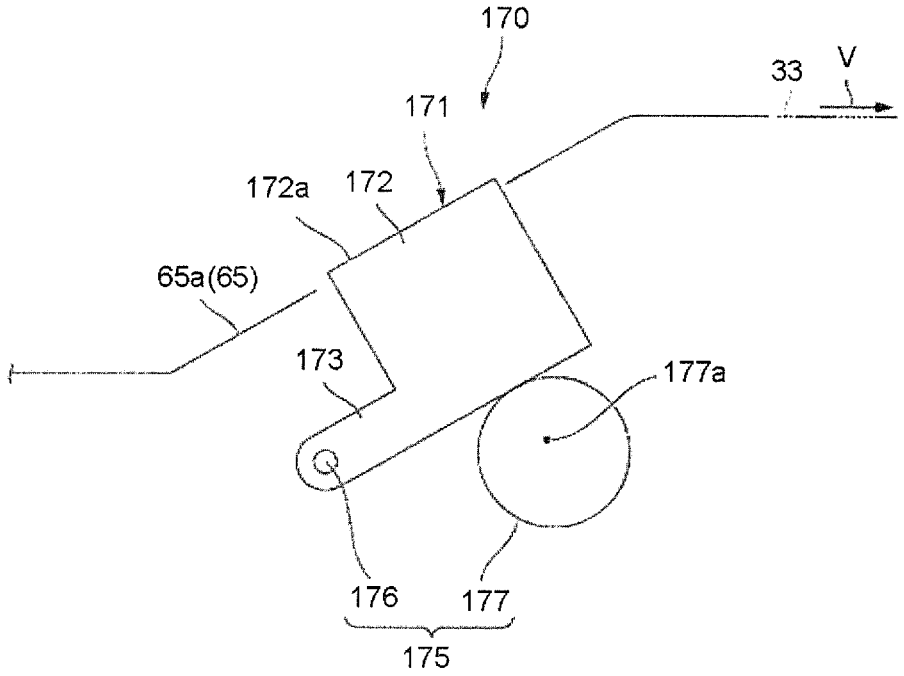
FIG. 9 is a side view illustrating main portions of a paper feed apparatus according to a first modification of the embodiment.

The friction force variable section 70 is not limited to having the energizing force variable mechanism 75. FIG. 9 is a side view illustrating the main portions of a paper feed apparatus of the first modification of the embodiment. For convenience, in FIG. 9, only the inclined surface 65*a* of the inclined section 65 is shown. As shown in FIG. 9, a friction force variable section 170 may be provided with an inclined altitude adjustment mechanism 175.

First, an abutting section 171 is described.

The abutting section 171 can abut against the sheet P sent out from the delivery section 55 (refer to FIG. 2). The abutting section 171 is provided with an abutting section main body 172 and an extending section 173.

The abutting section main body 172 is formed into a rectangular parallelepiped shape that is inclined in the direction along the inclined surface 65*a* of the inclined section 65. The abutting section main body 172 has a projecting surface 172*a* which is inclined along the inclined surface 65*a* of the inclined section 65. The projecting surface 172*a* slightly projects upwards with respect to the inclined surface 65*a* of the inclined section 65.

The extending section 173 is arranged at the side opposite the projecting surface 172*a* of the abutting section main body 172. The extending section 173 projects from the upstream side part of the abutting section main body 172 in the sheet conveyance direction V towards outside of the abutting section main body 172 in the direction along the inclined surface 65*a* of the inclined section 65.

Next, the inclined altitude adjustment mechanism 175 is described.

The inclined altitude adjustment mechanism 175 can adjust an inclined altitude (hereinafter, referred to as an "abutting section inclined altitude") of the abutting section 171 with respect to the sheet conveyance direction V between a first inclined altitude and a second inclined altitude. The second inclined altitude is inclined more steeply than the first inclined altitude.

The inclined altitude adjustment mechanism 175 includes an abutting section support shaft 176 and an inclined altitude adjusting cam 177.

The abutting section support shaft 176 rotatably supports the upstream side part of the abutting section 171 in the sheet conveyance direction V. Specifically, the abutting section support shaft 176 rotatably supports the extending section 173.

The inclined altitude adjusting cam 177 abuts against a surface opposite to the projecting surface 172*a* of the abutting section main body 172. The inclined altitude adjusting cam 177 rotates around a fulcrum 177*a* by a drive section (not shown) such as a motor. The inclined altitude adjusting cam 177 rotates in such a manner that the abutting section 171 swings around the abutting section support shaft 176, and in this way, the abutting section inclined altitude can be adjusted between the first inclined altitude and the second inclined altitude.

Hereinafter, a distance between a point where the inclined altitude adjusting cam 177 contacts with the abutting section 171 and the fulcrum 177*a* is referred to as a "variable distance". In a case in which the variable distance is smaller than a predetermined distance, the abutting section inclined altitude becomes relatively gentle. On the other hand, in a case in which the variable distance is greater than the predetermined distance, the abutting section inclined altitude becomes relatively steep. Thus, according to the rotation of the inclined altitude adjusting cam 177 by motor driving, the abutting section inclined altitude can be adjusted.

In the state shown in FIG. 9, the variable distance becomes the minimum. Thus, the abutting section inclined altitude becomes most gentle. In the state shown in FIG. 9, the abutting section inclined altitude corresponds to the first inclined altitude.

Figure 10:
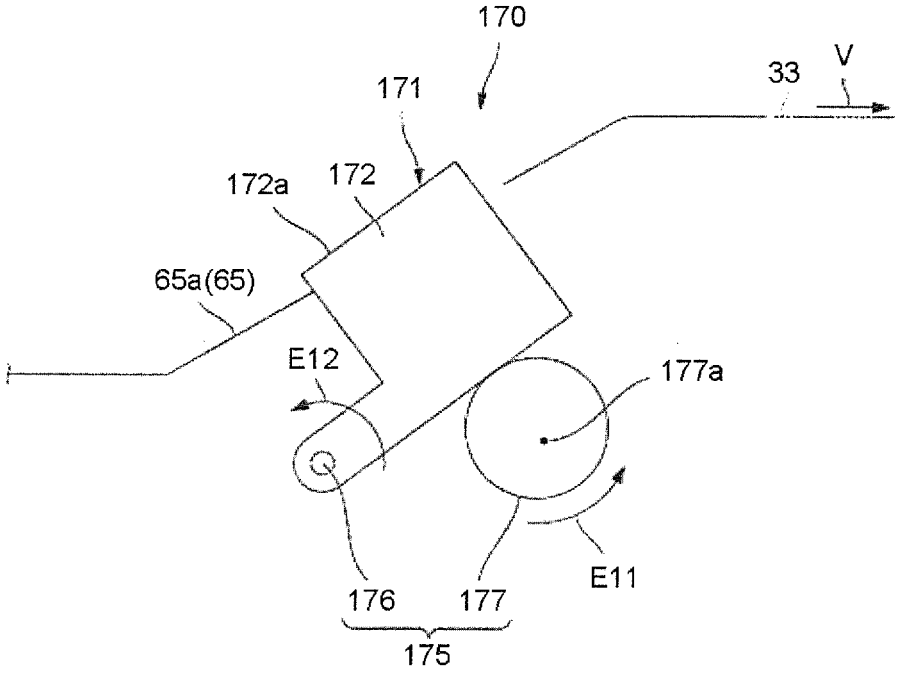
FIG. 10 is a view illustrating the operation of a friction force variable section according to the first modification of the embodiment.

FIG. 10 is a view illustrating the operation of the friction force variable section 170 according to the first modification of the embodiment. For convenience, in FIG. 10, only the inclined surface 65*a* in the inclined section 65 is shown. In the state shown in FIG. 10, the variable distance becomes the maximum due to the rotation of the inclined altitude adjusting cam 177 in the an arrow E11 direction. Thus, the abutting section 171 swings in an arrow E12 direction around the abutting section support shaft 176 and the abutting section inclined altitude becomes steepest. In the state shown in FIG. 10, the abutting section inclined altitude corresponds to the second inclined altitude Therefore, according to the rotation of the inclined altitude adjustment cam 177 by the motor driving, the abutting section inclined altitude can be adjusted between the first inclined altitude and the second inclined altitude.

According to the first modification, a large setting range of the friction force against sheet can be ensured as compared with the case in which the abutting section inclined altitude is kept constant. Since the friction force against sheet is easy to set according to the type of the sheet P, it is possible to further suppress the occurrence of the double feeding. In addition, with the simple structure using a cam mechanism, the occurrence of the double feeding can be further suppressed.

A second modification of the embodiment is described.

Figure 11:
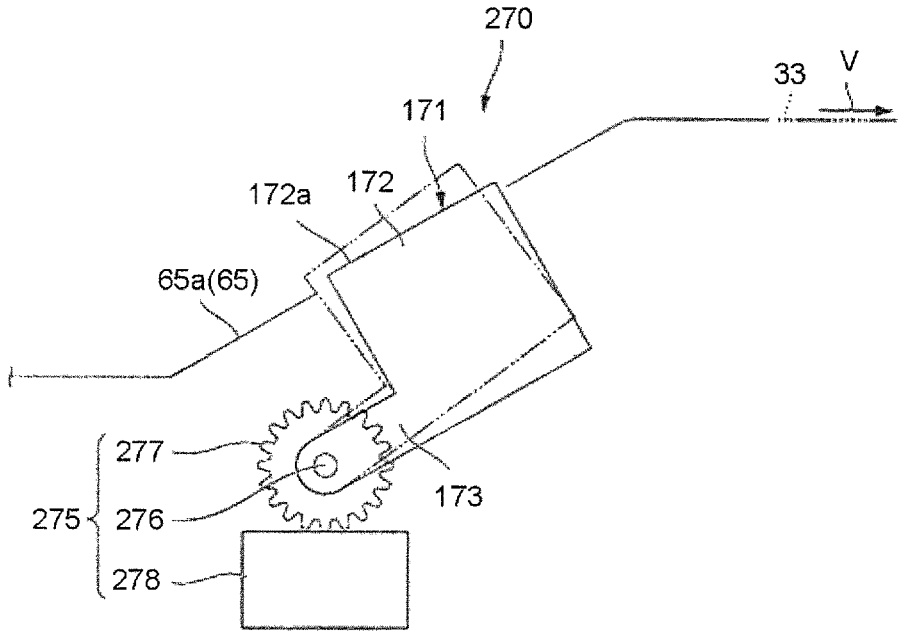
FIG. 11 is a side view illustrating main portions of a paper feed apparatus according to a second modification of the embodiment.

The inclined altitude adjustment mechanism 175 is not limited to having the abutting section support shaft 176 and the inclined altitude adjusting cam 177. FIG. 11 is a side view illustrating main portions of a paper feed apparatus according to a second modification of the embodiment. For convenience, in FIG. 11, only the inclined surface 65*a* of the inclined section 65 is shown. As shown in FIG. 11, in a friction force variable section 270, the inclined altitude adjustment mechanism 275 may include a fixed shaft 276, a gear 277 and a drive device 278.

The fixed shaft 276 fixedly supports the upstream side part of the abutting section 171 in the sheet conveyance direction V. Specifically, the fixed shaft 276 is fixed at the extending section 173. The gear 277 is jointed with the fixed shaft 276 in such a manner that the gear 277 is integrally rotatable with the fixed shaft 276. The drive device 278 includes a motor and a power transmission mechanism. For example, the gear 277 is driven by the motor via the power transmission mechanism. The gear 277 rotates integrally with the fixed shaft 276 by the driving of the motor. The gear 277 rotates integrally with the fixed shaft 276 in such a manner that the abutting section 171 swings around the fixed shaft 276, and in this way, the abutting section inclined altitude can be adjusted between the first inclined altitude and the second inclined altitude.

In a state shown by the solid line in FIG. 11, the abutting section inclined altitude corresponds to the first inclined altitude. On the other hand, in the state shown by the two-dot chain line in FIG. 11, the abutting section inclined altitude corresponds to the second inclined altitude.

According to the second modification, the occurrence of the double feeding can be further suppressed with a simple constitution using the gear.

A third modification of the embodiment is described.

Figure 12:
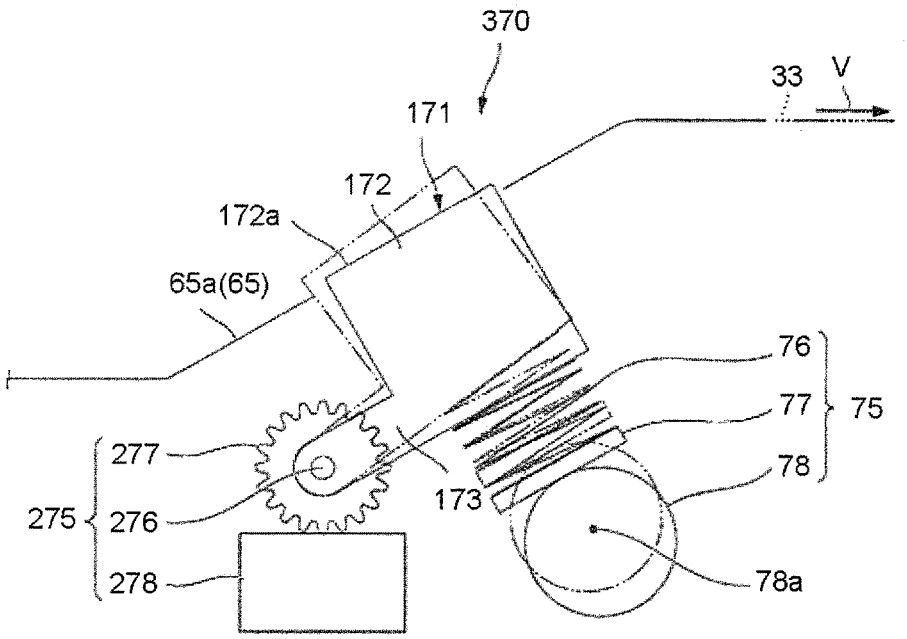
FIG. 12 is a side view illustrating main portions of a paper feed apparatus according to a third modification of the embodiment.

The friction force variable section is not limited to having only either the energizing force variable mechanism 75 or the inclined altitude adjustment mechanism 175 or 275. FIG. 12 is a side view illustrating main portions of a paper feed apparatus according to the third modification of the embodiment. For convenience, in FIG. 12, only the inclined surface 65*a* of the inclined section 65 is shown. As shown in FIG. 12, the friction force variable section 370 may include the energizing force variable mechanism 75 and the inclined altitude adjustment mechanism 275.

In a state shown by the solid line in FIG. 12, the energizing force against sheet corresponds to the first energizing force. In a state shown by the solid line in FIG. 12, the abutting section inclined altitude corresponds to the first inclined altitude.

On the other hand, in the state shown by the two-dot chain line in FIG. 12, the energizing force against sheet corresponds to the second energizing force. In the state shown by the two-dot chain line in FIG. 12, the abutting section inclined altitude corresponds to the second inclined altitude.

According to the third modification, a large setting range of the friction force against sheet can be ensured as compared with the case in which the friction force variable section is provided with only either the energizing force variable mechanism 75 or the inclined altitude adjustment mechanism 275. Therefore, since it is easy to set the friction force against sheet according to the type of the sheet P, the occurrence of the double feeding can be further suppressed.

A fourth modification of the embodiment is described.

The control device 110 is not limited to controlling the friction force variable section 70 based on the detection result of the humidity sensor 80. For example, the control device 110 may control the friction force variable section 70 based on a detection result of a temperature sensor (not shown). The temperature sensor detects temperature of the outside air. The control device 110 controls the friction force variable section 70 in such a way as to set the friction force against sheet to the reference friction force at the time the temperature of the outside air is lower than a preset temperature threshold value based on the detection result of the temperature sensor. The control device 110 controls the friction force variable section 70 in such a manner that the friction force against sheet is greater than the reference friction force at the time the temperature of the outside air is greater than the temperature threshold value.

According to the fourth modification, in a situation in which the double feeding may occur due to the high temperature of the outside air, the friction force variable section 70 is automatically operated at a proper timing and the friction force against for sheet can be automatically increased. Thus, the occurrence of the double feeding can be suppressed previously even in a situation where the double feeding may occur because the temperature of the outside air is high.

Other modifications of the embodiment are described.

The abutting section 71 is not limited to having the projecting surface 72*a* inclined along the inclined surface 65*a* of the inclined section 65. For example, the abutting section 71 may be formed into a stepwise shape which is inclined along the inclined surface 65*a* of the inclined section 65.

According to at least one embodiment described above, the paper feed apparatus 50 includes the delivery section 55, the separation section 60, the abutting section 71 and the friction force variable section 70. The delivery section 55 sends out the plurality of sheets that is overlapped towards the conveyance path 33. The separation section 60 is arranged at the downstream side of the delivery section 55 in the sheet conveyance direction V. The separation section 60 separates the plurality of the sheets P that is overlapped in a case in which the plurality of the sheets P sent out from the delivery section 55 is overlapped. The abutting section 71 is arranged between the delivery section 55 and the separation section 60 in the sheet conveyance direction V. The abutting section 71 abuts against the sheet P sent out from the delivery section 55. The friction force variable section 70 changes the friction force against sheet. With the above constitution, the following effect is achieved. The friction force variable section 70 changes the friction force against sheet, and in this way, it becomes easy to separate the plurality of the sheets P that is overlapped in a case in which the plurality of the sheets P sent out from the delivery section 55 is overlapped. Therefore, it is possible to suppress the occurrence of the double feeding.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A paper feed apparatus, comprising:

a paper feed section configured to feed an image receiving medium;

a separation section, arranged at a downstream side of the paper feed section in a conveyance direction of the image receiving medium, configured to separate a plurality of the image receiving media that is overlapped when the plurality of the image receiving media fed from the paper feed section is overlapped;

an abutting section, arranged between the paper feed section and the separation section in the conveyance direction of the image receiving medium, configured to abut against the image receiving medium fed from the paper feed section;

an inclined surface that is inclined so that a downstream side part thereof in the conveyance direction of the image receiving medium is positioned at a separation section side;

a friction force variable section configured to change a friction force of the abutting section against the image receiving medium;

a humidity sensor configured to detect humidity of outside air; and a control device configured to control the friction force variable section so that the friction force against image receiving medium fed from the paper feed section is set to a reference friction force at the time the humidity of the outside air is lower than a preset humidity threshold value; or, control the friction force variable section so that the friction force against image receiving medium fed from the paper feed section is greater than the reference friction force at the time the humidity of the outside air is greater than the humidity threshold value based on a detection result of the humidity sensor.

2. The paper feed apparatus according to claim 1, wherein the friction force variable section is provided with an energizing member for energizing the abutting section.

3. The paper feed apparatus according to claim 2, wherein the energizing member comprises a spring.

4. The paper feed apparatus according to claim 1, wherein the friction force variable section is provided with an energizing force variable mechanism for increasing and decreasing an energizing force of the abutting section against the image receiving medium fed from the paper feed section between a first energizing force and a second energizing force greater than the first energizing force.

5. The paper feed apparatus according to claim 4, wherein the energizing force variable mechanism is provided with an energizing member for energizing the abutting section so that the energizing force of the abutting section against the image receiving medium fed from the paper feed section is set to the first energizing force, and an energizing force adjusting cam for setting the energizing force of the abutting section against the image receiving medium fed from the paper feed section to the second energizing force by rotating against the energizing force of the energizing member.

6. The paper feed apparatus according to claim 1, wherein the friction force variable section is provided with an inclined altitude adjustment mechanism for adjusting an inclined altitude of the abutting section with respect to the conveyance direction of the image receiving medium between a first inclined altitude and a second inclined altitude steeper than the first inclined altitude.

7. The paper feed apparatus according to claim 6, wherein the inclined altitude adjustment mechanism is provided with an abutting section support shaft rotatably supporting an upstream side part of the abutting section in the conveyance direction of the image receiving medium, and an inclined altitude adjusting cam for adjusting the inclined altitude of the abutting section with respect to the conveyance direction of the image receiving medium between the first inclined altitude and the second inclined altitude by rotating in such a manner that the abutting section swings around the abutting section support shaft.

8. The paper feed apparatus according to claim 1, further comprising:

an inclined section, arranged between the paper feed section and the separation section in the conveyance direction of the image receiving medium, comprising the inclined surface that is inclined so that the downstream side part thereof in the conveyance direction of the image receiving medium is positioned at the separation section side, wherein the abutting section comprises a projecting surface that is inclined along the inclined surface and projects over the inclined surface of the inclined section.

9. The paper feed apparatus according to claim 1, wherein a conveyance state detection sensor configured to detect a conveyance state of the image receiving medium passing through the separation section, and a control device configured to control the friction force variable section so that the friction force against image receiving medium fed from the paper feed section is set to a reference friction force when the number of the image receiving media passing through the separation section is one; or, control the friction force variable section so that the friction force against image receiving medium fed from the paper feed section is greater than the reference friction force when a plurality of the image receiving media passing through the separation section is overlapped based on a detection result of the conveyance state detection sensor.

10. An image forming apparatus, comprising:

an image forming section configured to form an image on an image receiving medium; and a paper feed apparatus configured to supply the image receiving medium towards the image forming section, the paper feed apparatus comprising:

a paper feed section configured to feed the image receiving medium;

a separation section, arranged at a downstream side of the paper feed section in a conveyance direction of the image receiving medium, configured to separate a plurality of the image receiving media that is overlapped when the plurality of the image receiving media fed from the paper feed section is overlapped;

an abutting section, arranged between the paper feed section and the separation section in the conveyance direction of the image receiving medium, configured to abut against the image receiving medium fed from the paper feed section;

an inclined surface that is inclined so that a downstream side part thereof in the conveyance direction of the image receiving medium is positioned at a separation section side;

a friction force variable section configured to change a friction force of the abutting section against the image receiving medium;

a humidity sensor configured to detect humidity of outside air; and a control device configured to control the friction force variable section so that the friction force against image receiving medium fed from the paper feed section is set to a reference friction force at the time the humidity of the outside air is lower than a preset humidity threshold value; or, control the friction force variable section so that the friction force against image receiving medium fed from the paper feed section is greater than the reference friction force at the time the humidity of the outside air is greater than the humidity threshold value based on a detection result of the humidity sensor.

11. A paper feed method, comprising:

feeding an image receiving medium from a paper feed section;

at a downstream side of the paper feed section in a conveyance direction of the image receiving medium, separating a plurality of the image receiving media that is overlapped when the plurality of the image receiving media fed from the paper feed section is overlapped;

abutting an abutting section against the image receiving medium fed from the paper feed section;

inclining an inclined surface so that a downstream side part thereof in the conveyance direction of the image receiving medium is positioned at a separation section side;

changing a friction force of the abutting section against the image receiving medium;

detecting humidity of outside air; and controlling the friction force against image receiving medium fed from the paper feed section to a reference friction force at the time the humidity of the outside air is lower than a preset humidity threshold value; or, controlling the friction force against image receiving medium fed from the paper feed section to greater than the reference friction force at the time the humidity of the outside air is greater than the humidity threshold value based on a humidity detection result.

12. The paper feed method according to claim 11, further comprising:

energizing the abutting section with an energizing member.

13. The paper feed method according to claim 11, further comprising:

increasing and decreasing an energizing force of the abutting section against the image receiving medium fed from the paper feed section between a first energizing force and a second energizing force greater than the first energizing force with an energizing force variable mechanism.

14. The paper feed method according to claim 13, further comprising:

energizing the abutting section in such a manner that the energizing force of the abutting section against the image receiving medium fed from the paper feed section is set to the first energizing force, and setting the energizing force of the abutting section against the image receiving medium fed from the paper feed section to the second energizing force by rotating against the energizing force of the energizing member.

15. The paper feed method according to claim 11, further comprising:

adjusting an inclined altitude of the abutting section with respect to the conveyance direction of the image receiving medium between a first inclined altitude and a second inclined altitude steeper than the first inclined altitude.

16. The paper feed method according to claim 15, further comprising:

rotatably supporting an upstream side part of the abutting section in the conveyance direction of the image receiving medium, and adjusting the inclined altitude of the abutting section with respect to the conveyance direction of the image receiving medium between the first inclined altitude and the second inclined altitude by rotating so that the abutting section swings around the abutting section support shaft.

17. The paper feed method according to claim 11, further comprising:

detecting a conveyance state of the image receiving medium passing through a separation section, and controlling the friction force against image receiving medium fed from the paper feed section to a reference friction force when the number of the image receiving media passing through the separation section is one; or, controlling the friction force against image receiving medium fed from the paper feed section to be greater than the reference friction force when the plurality of the image receiving media passing through the separation section is overlapped based on a detection result.

* * * * *